US005779057A

United States Patent [19]

LePage et al.

[11] Patent Number: 5,779,057

[45] Date of Patent: Jul. 14, 1998

[54] RIGID REMOVABLE CARRIER TRAYS

[75] Inventors: Michael LePage, Tiverton; Keith Morrison, Jamestown; Ronald Schmitt, Coventry; Paul Chauvin, Cumberland, all of R.I.

[73] Assignee: Augat Inc, Mansfield, Mass.

[21] Appl. No.: 740,718

[22] Filed: Nov. 4, 1996

[51] Int. Cl.[6] ..... B65D 85/46

[52] U.S. Cl. ..... 206/722; 206/486; 206/511

[58] Field of Search ..... 206/716, 722, 206/723, 724, 486, 562, 563, 509, 511, 726, 728

[56] References Cited

U.S. PATENT DOCUMENTS

| | | | |
|---|---|---|---|
| Re. 32,540 | 11/1987 | Murphy . | |
| 3,809,233 | 5/1974 | Gruszka | 206/722 |
| 4,099,615 | 7/1978 | Lemke et al. | 206/716 |
| 4,242,834 | 1/1981 | Olsen | 206/562 |
| 4,349,109 | 9/1982 | Scordato et al. | 206/562 |
| 4,787,510 | 11/1988 | Powell | 206/716 |
| 4,887,981 | 12/1989 | Damon et al. . | |
| 4,913,286 | 4/1990 | Tate | 206/722 |
| 5,047,019 | 9/1991 | Sincock | 206/486 |
| 5,207,325 | 5/1993 | Kennedy | 206/511 |
| 5,337,893 | 8/1994 | Nami et al. | 206/722 |
| 5,397,254 | 3/1995 | Powell . | |
| 5,487,997 | 1/1996 | Stoip | 206/563 |

*Primary Examiner*—Paul T. Sewell
*Assistant Examiner*—Nhan T. Lam
*Attorney, Agent, or Firm*—Weingarten, Schurgin, Gagnebin & Hayes LLP

[57] ABSTRACT

Disclosed is a rigid removable carrier tray for transporting and storing pin sockets. The tray includes one or more arrays of holes of consistent or varying diameter disposed in an upper surface and formed to receive pin sockets. Pin sockets are recessed below the upper surface of the carrier tray when placed in the holes. A flexible adhesive film is disposed over the upper surface of the carrier tray to prevent the pin sockets from falling out of the carrier tray during transport. The pin sockets are installed by removing the adhesive film and press fitting the leads of an integrated circuit ("IC") chip into the pin sockets in the holes. The holes in the array may be arranged in a customized pattern in order to accommodate a particular IC chip, or may be arranged in a generic pattern to accept a variety of IC chips. The carrier tray also includes standoffs with alignment guides and troughs that facilitate stacking and storage. More particularly, the standoffs include alignment guides that are interfaced with the troughs to maintain alignment of one tray with respect to another while the standoffs provide interspacing between vertically stacked trays.

13 Claims, 4 Drawing Sheets

RIGID REMOVABLE CARRIER TRAYS

FIELD OF THE INVENTION

The present invention relates generally to electrical connectors, and more particularly to reusable pin socket carriers and methods for transporting, storing, installing and handling pin sockets.

BACKGROUND OF THE INVENTION

Pin sockets are used for a variety of purposes in the construction of electronic hardware. For example, pin sockets are sometimes employed to provide connection between leads on an integrated circuit ("IC") chip and a printed circuit board. To do this, the pin sockets are soldered into through-holes on the printed circuit board. The leads of the IC chip are subsequently inserted into the appropriate corresponding pin sockets. Alternatively, IC chip leads and pin sockets may be preassembled before soldering into a PCB. In order to decrease manufacturing costs, it is desirable to reduce the effort required to insert the pin sockets and integrated circuit ("IC") chip into the printed circuit board.

It is known to use a flexible film to temporarily interconnect a group of pin sockets for insertion into a printed circuit board. The pin sockets are inserted into holes in the film and transported in groups. This technique is more efficient than handling pin sockets individually, however, there remains a need for apparatus to transport, store and otherwise facilitate handling of pin sockets.

SUMMARY OF THE INVENTION

In accordance with the present invention, a carrier tray for transportation and storage of groups of pin sockets having upper and lower sections of predetermined diameter where the upper section diameter is greater than the lower section diameter, comprises: a rigid carrier body with upper and lower surfaces, the carrier body having at least one array of holes disposed through the upper surface, the holes including upper and lower sections, the lower hole section having a diameter that is less than the diameter of the pin socket upper section; whereby groups of pin sockets may be transported and stored by placing individual pin sockets in the holes and stacked transport of sockets with IC chips applied thereto is possible.

The rigid carrier tray of the present invention advantageously provides a structure that holds a plurality of pin sockets in a predetermined pattern for installation. More particularly, the rigidity of the carrier tray facilitates stacking and installation of groups of pin sockets. The pin sockets are held in place during transport by an adhesive film that is placed over an upper surface of the carrier tray and adheres thereto. Carrier trays that are loaded with pin sockets can then be compactly stored by stacking. Prior to installation, the adhesive film is removed. An integrated circuit ("IC") chip is then placed over a group of pin sockets in the tray, and the IC chip leads are press fitted into the pin sockets. The IC chip and pin sockets are then lifted out of the carrier tray and installed on a printed circuit board.

BRIEF DESCRIPTION OF THE DRAWING

Other features and advantages of the invention will become apparent in light of the following detailed description of the drawing in which.

DETAILED DESCRIPTION OF THE DRAWING

Figure 1:
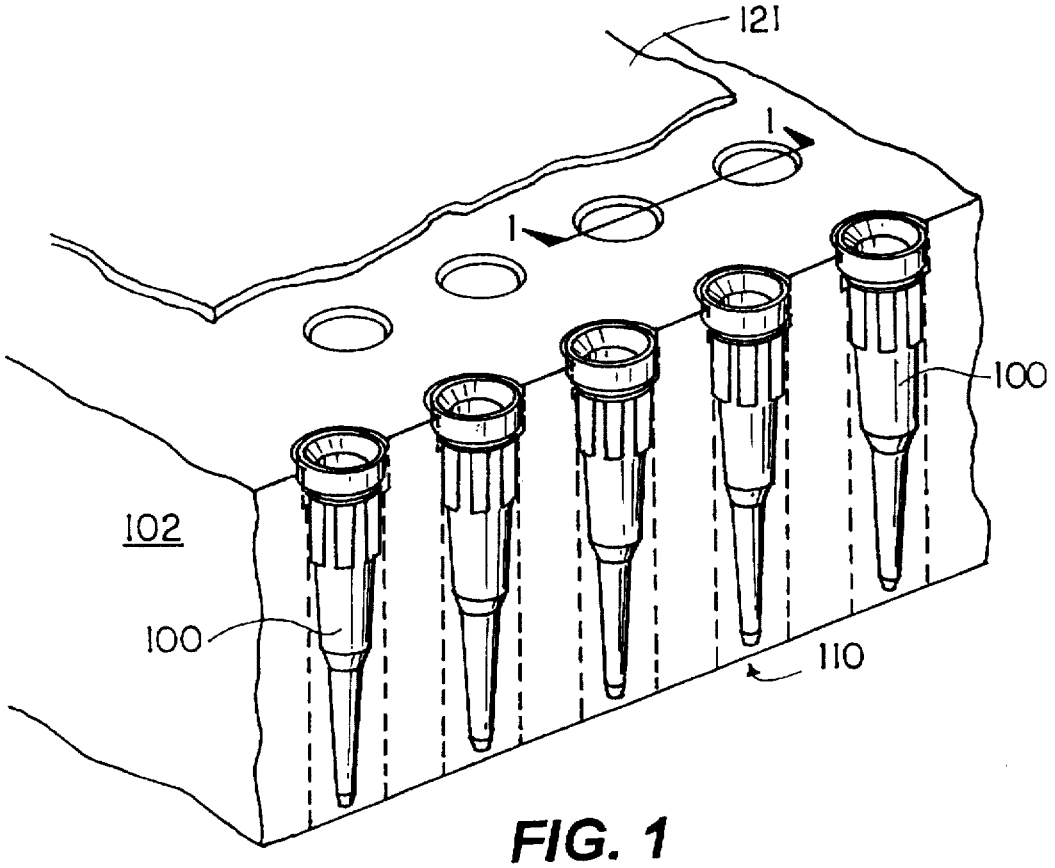
FIG. 1 is a partially cutaway perspective view of a group of pin sockets in a rigid removable carrier tray.
Figure 2:
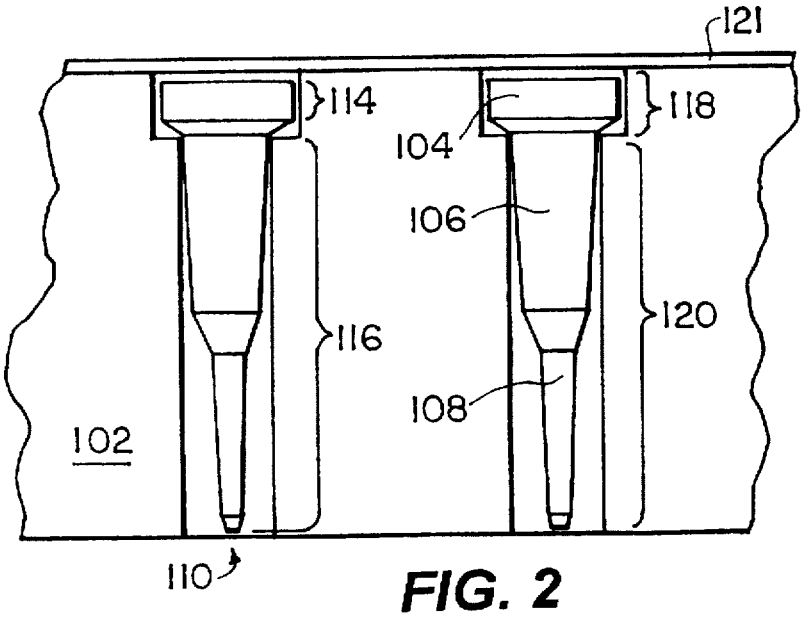
FIG. 2 is a cross-sectional view of a section of the rigid removable carrier tray of FIG. 1 taken along line 1—1.

FIGS. 1 and 2 illustrates a group of pin sockets 100 disposed in a rigid removable carrier 102. Each pin socket includes a head 104, a sleeve 106 and a lead 108. The carrier includes a plurality of holes 110 for receiving the pin sockets 100. Once disposed in the holes, the pin sockets are secured in place by an adhesive film 121.

Each pin socket 100 has a cylindrical cross section with a varying outside diameter. More particularly, each pin socket has at least an upper section 114 and a lower section 116, where the upper section has a greater diameter than the lower section. The sleeve 106 is connected to both the lead 108 and the head 104, at opposing ends. The lead section is substantially solid and has a smaller outside diameter than the sleeve section. The sleeve section has a smaller diameter than the head section, and both the sleeve and head are substantially hollow, defining an internal bore therein.

The holes 110 in the rigid removable carrier tray are formed to receive the pin sockets. Each hole has a circular cross-section of varying diameter. More particularly, each hole has at least an upper section 118 and a lower section 120, where the upper section has a greater diameter than the lower section. The upper hole section 118 diameter is greater than or equal to the upper pin socket section 114 diameter. The lower hole section 120 diameter is greater than or equal to the lower pin socket section 116 diameter, and less than the upper pin socket section 114 diameter. The upper and lower hole sections are deeper than the upper pin socket sections such that the pin sockets are recessed when within the upper holes. Thus, the holes support pin sockets that are placed therein, and the pin sockets are recessed within the holes.

Figure 3:
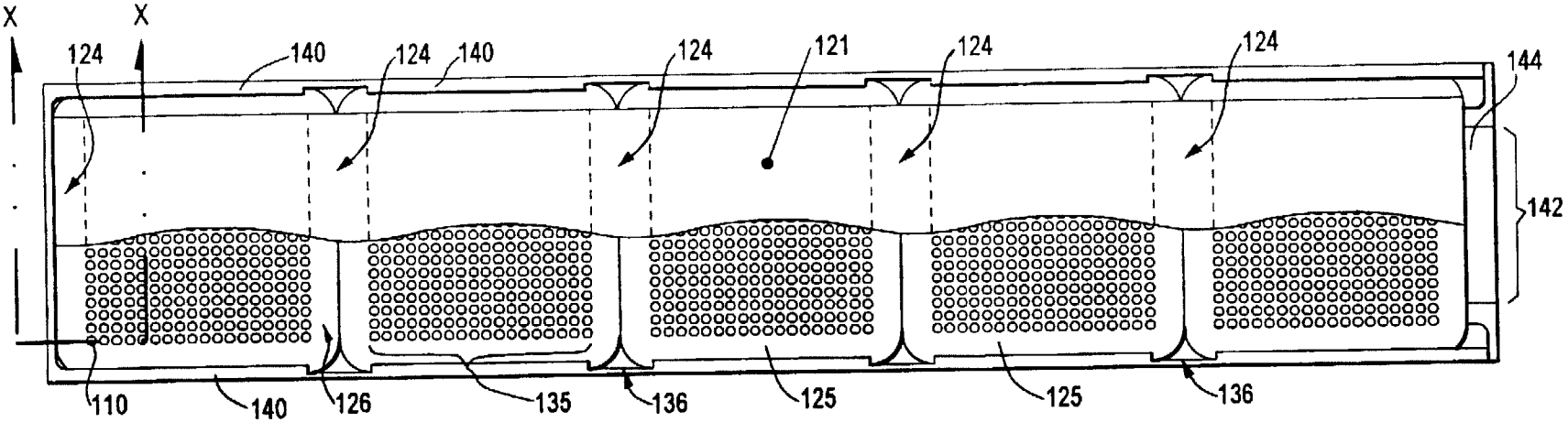
FIG. 3 is a top view of the rigid removable carrier tray.
Figure 4:
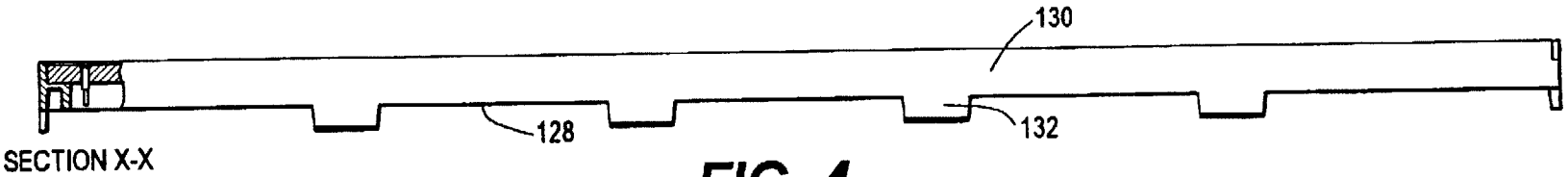
FIG. 4 is side view of the rigid removable carrier tray.
Figure 5:
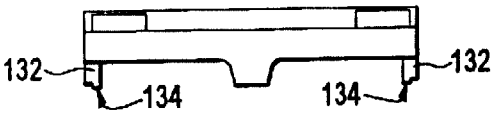
FIG. 5 is an end view of the rigid removable carrier tray.
Figure 6:
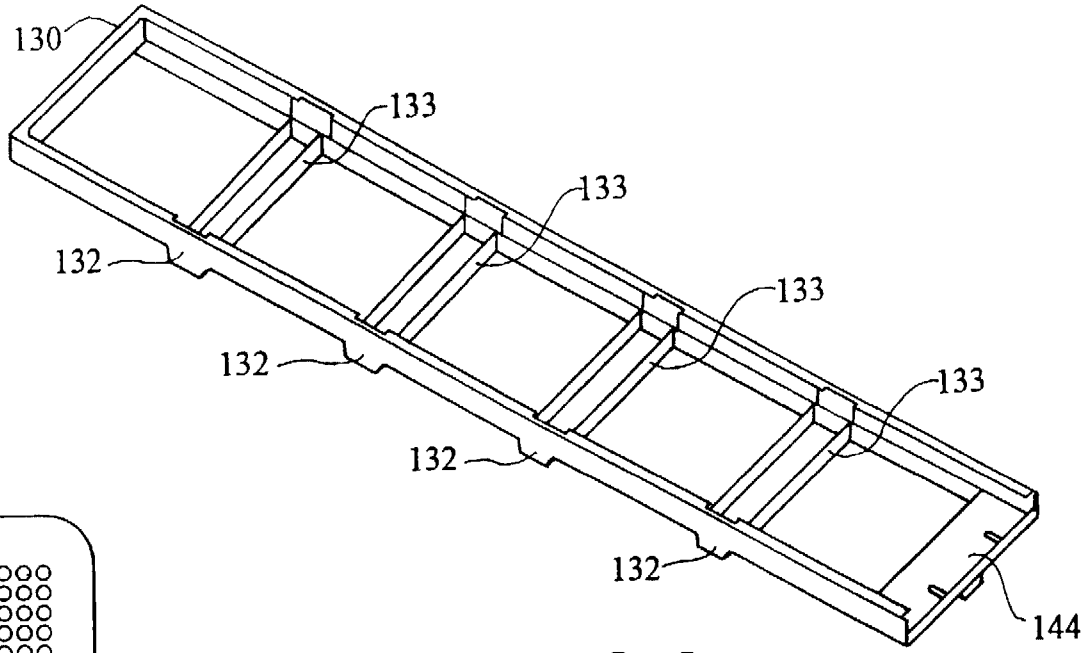
FIG. 6 is a perspective view of the frame.
Figure 7:
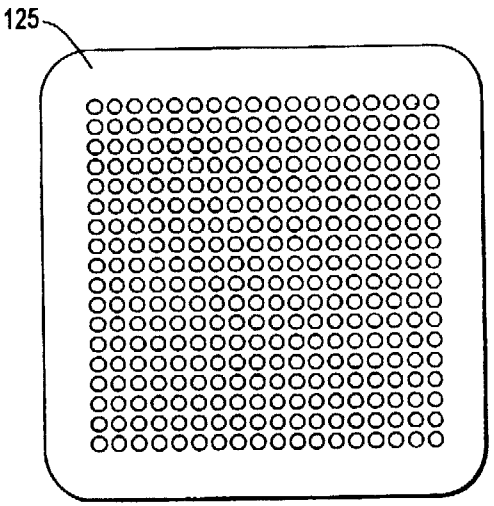
FIG. 7 is a top view of the insulating body.
Figure 8:
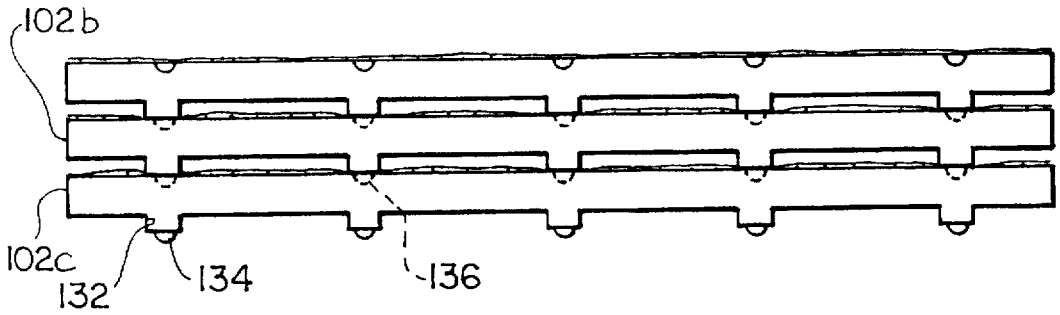
FIG. 8 illustrates stacked rigid removable carrier trays.

Referring to FIGS. 1–3, the pin sockets are held in place by an adhesive film 121, such as an adhesive mylar tape. The film is flexible and includes a plurality of adhesive sections 124. The adhesive sections are located between adjacent arrays 135 of holes. Sections of the film that are disposed directly over the arrays of holes do not include adhesive. As such, the film adheres to the carrier tray but not to the pin sockets.

Referring now to FIGS. 3–7, the carrier tray includes a frame and a plurality of electrically insulating bodies. The electrically insulating bodies 125 are formed to receive the pin sockets, and the frame 130 is formed to receive the insulating bodies. The insulating bodies 125 have upper 126 and lower 128 planar surfaces with holes disposed therethrough. The frame 130 has standoffs 132 disposed thereon, and includes at least four support beams 133 that are interconnected at right angles to form a rectangular box. The standoffs are disposed on the frame 130, and an alignment guide 134 is disposed on each standoff 132. An alignment trough 136 is disposed on the upper surface 126 of the body, substantially in alignment with each alignment guide 134. Both the frame and the insulating bodies may be constructed of polycarbonate or other material with appropriate electrostatic properties. Further, the standoffs, frame and insulating bodies may be formed separately and joined, or formed simultaneously in a single injection mold.

The arrays 135 of holes 110 are formed in each insulating body 125 to receive groups of pin sockets. Within each array, the holes may be arranged in a generic pattern in order to accommodate a variety of patterns in which integrated circuit ("IC") chip leads may be encountered during use, or arranged in a predetermined pattern designed to accommodate a particular IC chip. As shown, the arrays of holes include evenly spaced and aligned columns and rows that accommodate a variety of patterns and are well suited to use with pin grid arrays.

The frame 130 is formed to receive and hold the insulating bodies 125. More particularly, the frame includes retaining edges 140 that form slots allowing insertion of the insulating bodies from an open side 142. The insulating bodies may be inserted singly or adhered together and inserted in one motion. The open side of the frame includes a block 144 with a press fit alignment feature for securing the inserted insulating bodies in place.

Referring to FIGS. 2–5 & 8, the carrier tray is advantageously designed to be stacked with other such trays, thereby providing compact storage of pin sockets. The alignment guides 134 are disposed on the standoffs 132 in vertical alignment with the alignment troughs 136. Hence, carrier trays can be stacked by placing a second level tray **102*b* on a first level tray 102*a*** such that the alignment guides of the second level tray interface with the alignment troughs of the first level tray. Additional trays can be stacked on the second level tray in a similar fashion. The arrays, alignment troughs and alignment guides are equally spaced such that stacked carrier trays may be interleaved to provide additional stability. Predetermined vertical spacing between trays is provided by the standoffs to allow for stacked transport of sockets with IC chips applied.

Figure 9:
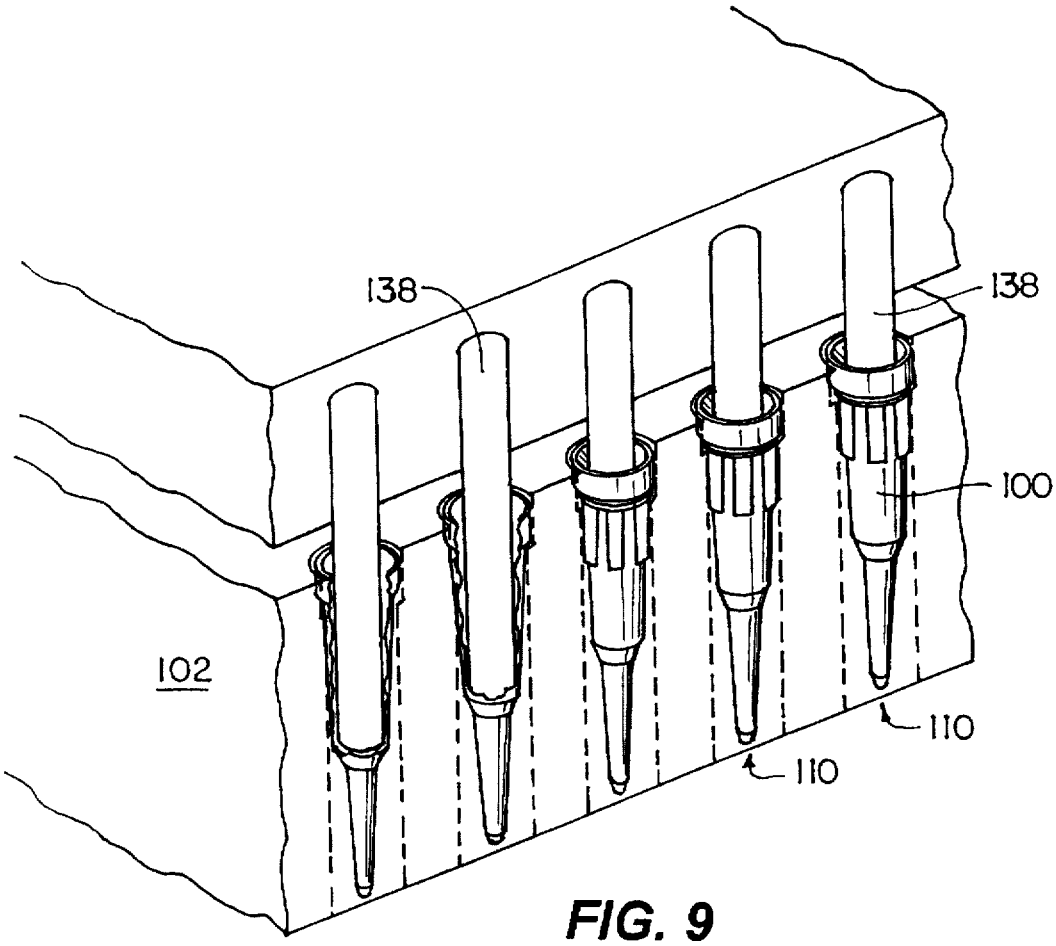
FIG. 9 illustrates pin sockets being fitted to IC chip leads.

Referring to FIG. 3 and FIG. 9, installing pin sockets on IC chip leads 138 is facilitated because the carrier tray is rigid and the pin sockets are pre-arranged for installation. Prior to installation, the mylar film 121 is lifted away from the carrier tray. The film may be provided in separate sections or be perforated to facilitate removal from above a single group of pin sockets without disturbing other groups of pin sockets in the carrier. The IC is then placed over the array of pin sockets such that the IC leads 138 are aligned with the pin sockets 100, and the IC leads are press fitted into the pin sockets. The internal bores, in the pin sockets provide such a press fit to the IC leads. The IC and array of pin sockets fitted thereto are then removed from the carrier tray, installed on the PCB and soldered in place.

It should be understood that the invention is not limited to the particular embodiment shown and described herein and that various changes and modification may be made without departing from the spirit and scope of this novel concept as defined by the following claims.

What is claimed is:

1. A carrying device for transportation and storage of groups of pin sockets, each having an overall length dimension and an upper section and lower section of predetermined length and diameter, where the upper section diameter is greater than the lower section diameter, comprising:

a frame section with first and second members interconnected by at least one support beam; and a rigid body with upper and lower surfaces, said body disposed in said frame and having at least one array of holes disposed through said upper surface, said holes including upper and lower sections, said hole lower section having a diameter that is less than the pin socket upper section diameter, said hole upper section having a length dimension which is approximately equal to the length dimension of the upper section of the pin socket;

whereby groups of pin sockets may be transported and stored by placing individual pin sockets in said holes, the upper section of each pin socket being approximately flush with the upper surface of the rigid body during transport.

2. The carrying device of claim 1 including a plurality of standoffs disposed on said lower surface of said body.

3. The carrying device of claim 2 including a plurality of alignment troughs disposed through said upper surface of said body.

4. The carrying device of claim 3 including at least one alignment guide disposed on each of said standoffs to interface with said alignment troughs to facilitate alignment of said carrier trays when said carrier trays are stacked.

5. The carrying device of claim 1 wherein said frame includes a retaining feature for securing said body within said frame.

6. The carrying device of claim 5 wherein said body is formed from a first material and said frame is formed from a second material.

7. The carrying device of claim 6 wherein said first material is an electrical insulator.

8. The carrying device of claim 1 further including a flexible film disposed above said upper surface.

9. The carrying device of claim 8 wherein said film includes at least one adhesive surface, said adhesive surface disposed against said upper surface.

10. The carrying device of claim 9 wherein said film is a Mylar tape.

11. The carrying device of claim 1 wherein the frame extends beyond the lower surface of the rigid body and at least a portion of the lower section of the pin socket extends beyond the lower surface of the rigid body but not beyond the frame.

12. A carrier for transportation and storage of groups of pin sockets having upper and lower sections of predetermined diameter, comprising:

a rigid carrier body with upper and lower surfaces, said carrier body having at least one array of holes disposed in said upper surface, said holes including upper and lower sections, said upper and lower hole sections having a greater diameter than said upper and lower pin socket sections, respectively;

at least one alignment trough disposed through said upper surface of said carrier body; and a plurality of standoffs disposed on said lower surface of said carrier body, at least one of said standoffs including an alignment guide to interface with said alignment trough.

13. The carrier of claim 12 further including a flexible film with at least one adhesive surface, said film disposed adhered to said upper surface such that the pin sockets in said holes are prevented from falling out of said holes, whereby groups of pin sockets may be transported and stored by placing individual pin sockets in said holes and securing the pin sockets in said holes with said film.

* * * * *